United States Patent [19]

Wincklhofer

[11] Patent Number: 4,886,691

[45] Date of Patent: Dec. 12, 1989

[54] CUT RESISTANT JACKET FOR ROPES, WEBBING, STRAPS, INFLATABLES AND THE LIKE

[75] Inventor: Robert C. Wincklhofer, Richmond, Va.

[73] Assignee: Allied-Signal Inc., Morris Township, Morris County, N.J.

[21] Appl. No.: 277,486

[22] Filed: Nov. 29, 1988

Related U.S. Application Data

[63] Continuation-in-part of Ser. No. 140,530, Jan. 4, 1988, abandoned, which is a continuation-in-part of Ser. No. 873,669, Jun. 12, 1986, abandoned.

[51] Int. Cl.[4] ..... B32B 1/04

[52] U.S. Cl. ..... 428/68; 57/210; 27/6; 428/224; 428/229; 428/253; 428/257; 428/902

[58] Field of Search ..... 428/68, 74, 76, 224, 428/229, 257, 253, 373, 902; 57/210; 87/6

[56] References Cited

U.S. PATENT DOCUMENTS

| | | | |
|---|---|---|---|
| 4,321,854 | 3/1982 | Foote et al. | 57/210 |
| 4,384,449 | 5/1983 | Byrnes et al. | 57/210 |
| 4,470,251 | 9/1984 | Beltcher | 57/210 |
| 4,651,514 | 3/1987 | Collett | 57/227 |

FOREIGN PATENT DOCUMENTS

| | | |
|---|---|---|
| 0027708 | 10/1980 | European Pat. Off. . |
| 0050011 | 10/1981 | European Pat. Off. . |
| 0133205 | 6/1984 | European Pat. Off. . |
| 0168774 | 7/1985 | European Pat. Off. . |
| 7906321 | 3/1979 | Fed. Rep. of Germany . |
| 8313102 | 6/1983 | Fed. Rep. of Germany . |

*Primary Examiner*—James J. Bell

*Attorney, Agent, or Firm*—Richard A. Anderson

[57] ABSTRACT

This invention is a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber.

13 Claims, No Drawings

CUT RESISTANT JACKET FOR ROPES, WEBBING, STRAPS, INFLATABLES AND THE LIKE

This application is a continuation of application Ser. No. 140,530 filed Jan. 4, 1988 now abandoned which is a continuation-in-part of Ser. No. 873,669, filed June 12, 1986, now abandoned.

BACKGROUND OF THE INVENTION

This invention relates to a cut resistant jacket for ropes, webbing, straps, inflatables and the like, more particularly a cut resistant article comprising a cut resistant jacket surrounding a less cut resistant member where the jacket comprises a fabric of a yarn and the yarn consists essentially of a high strength, longitudinal strand having a tensile strength of at least 1 GPa and the strand is wrapped with a fiber.

It is known to make cut resistant fabric for gloves used for safety in the meat cutting industry. For example see U.S. Pat. No. 4 470 251, U.S. Pat. No. 4 384 449 and U.S. Pat. No. 4 004 295 all hereby incorporated by reference. It is also known to make a composite line containing two different filamentary materials in the form of a core and a jacket of different tensile strengths and elongations as in U.S. Pat. No. 4 321 854 hereby incorporated by reference. It is also known to make composite strand, cables, yarns, ropes, textiles, filaments and the like in other prior U.S. patents not cited herein.

By ultrahigh molecular weight is meant 300,000 to 7,000,000. Normal molecular weight is then below 300,000.

By fiber herein is meant any thread, filament or the like, alone or in groups of multifilaments, continuous running lengths or short lengths such as staple.

By yarn herein is meant any continuous running length of fibers, which may be wrapped with similar or dissimilar fiber, suitable for further processing into fabric by braiding, weaving, fusion bonding, tufting, knitting or the like, having a denier less than 10,000.

By strand herein is meant either a running length of multifilament end or a monofilament end of continuous fiber or spun staple fibers, preferably untwisted, having a denier less than 2,000, or metal of diameter less than 0.01 inches.

SUMMARY OF THE INVENTION

This invention is a cut resistant article comprising a cut resistant jacket surrounding a less cut resistant member. The jacket comprises a fabric of yarn. The yarn consists essentially of a high strength, longitudinal strand having a tensile strength of at least 1 GPa. More than one strand can be used. This strand (or strands) is wrapped with a fiber. The fiber may be the same or different than the longitudinal yarn.

It is preferred that the fiber wrapped around the strand also have a tensile strength of at least 1 GPa.

The less cut resistant member can be selected from the group consisting of rope, webbing, strap, hose and inflatable structures.

The core strand fiber of the rope, webbing, strap or inflatable structures could be fiber of nylon, polyester, polypropylene, polyethylene, aramid, ultrahigh molecular weight high strength polyethylene or any other known fiber for the use.

The inflatable structure would be a less cut resistant layer having the fabric of this invention as a jacket or outer layer. The strand used for the fiber in the jacket may be selected from the group consisting of an aramid, ultrahigh molecular weight polyolefin, carbon, metal, fiber glass and combinations thereof. The fiber used to wrap the longitudinal strand (or strands) can be selected from the group consisting of an aramid fiber, ultrahigh molecular weight polyolefin fiber, carbon fiber, metal fiber, polyamide fiber, polyester fiber, normal molecular weight polyolefin fiber, fiber glass, polyacrylic fiber and combinations thereof. When the fiber wrapping is a high strength fiber having strength over 1 GPa, the preferred fiber wrapping is selected from the group consisting of aramid fiber, ultra high molecular weight polyolefin fiber, carbon fiber, metal fiber, fiber glass and combinations thereof.

The polyolefin fiber of this invention can be ultrahigh molecular weight polyethylene or polypropylene, preferably polyethylene, commercial examples are Spectra®900 or Spectra®1000.

The fiber wrapping can also be a blend of a lower strength fiber with the high strength fiber. Such lower strength fiber can be selected from the group consisting of polyamide, polyester, fiber glass, polyacrylic fiber and combinations thereof.

The article of this invention can also have more than one jacket surrounding the less cut resistant member.

In another embodiment, the article of this invention has a material present in the interstices of the fabric of the jacket to bond the yarn of the fabric to adjacent yarn of the fabric thereby increasing penetration resistance of the jacket. The material used in the interstices can be any elastomer, preferably a thermoplastic rubber and more preferably a material selected from the group consisting of polyurethane, polyethylene and polyvinyl chloride.

DESCRIPTION OF THE PREFERRED EMBODIMENTS

Yarns for Jacket Fabric

A yarn to be used to make the protective jacket fabric is made by wrapping one longitudinal strand of stainless steel wire having a diameter of 0.11 mm and one parallel strand of an ultrahigh molecular weight polyethylene fiber having a tensile strength of 3 GPa modulus of 171 GPa, elongation of 2.7 percent, denier of 650 and 120 filaments per strand or end. This yarn is commercially available as Spectra®1000 fiber from Allied Corporation. The wrapping fiber is a polyester of 500 denier, 70 filaments per end, having a tensile strength of 1.00 GPa, modulus of 13.2 GPa, elongation of 14 percent. For yarn A two layered wraps of the above polyester fiber are used to wrap the parallel strands of wire and high strength polyethylene.

For yarn B one layer of the ultrahigh molecular weight polyethylene fiber described above is used as the innermost layer wrapped around the strands, the outer layer being the polyester fiber.

Alternatively, an aramid such as Kevlar could be used to replace the ultrahigh molecular weight polyethylene, either as the strand or as the fiber for wrapping.

Comparative Yarn C—a polyester of 3600 denier, 1 GPa tensile strength, 13.2 GPa modulus and 14 percent elongation, without wrapping.

This wrapped yarn (A or B) or comparative yarn C can then be braided, knitted, woven or otherwise made into fabric used as the jacket of this invention.

This jacket can then be used to surround ropes, webbing, straps, inflatable structure, and the like. The jacket can be made from one or more ends of yarn per carrier in the braider apparatus. Either full or partial coverage of the core of braided or parallel strands can be achieved. The yarn for the fabric used for the jacket in this invention can also be wrapped in a conventional manner such as simply wrapping the strand of high strength fiber or by core spinning or by Tazalanizing or any other method to put a wrap of yarn around the strand or strands.

EXAMPLE 1

Tests on Ropes

Three different stranded ropes, jacketed with a cut protective fabric, were tested for cut resistance. Three conventional stranded ¼-inch (0.6 cm) ropes were made and a special braided yarn fabric was used to surround the rope core as a jacket. The jacket can be formed either separately and placed on the core of rope or formed around the core during one of the manufacturing steps.

Comparative Sample 1 was a Kevlar stranded rope jacketed with fabric braided from comparative yarn C. Comparative Sample 2 was an ultrahigh molecular weight high strength polyethylene (Spectra ®900) fiber stranded rope jacketed with fabric braided from comparative yarn C. Example of this invention Sample 3 was the above-described ultrahigh molecular weight polyethylene (Spectra ®) fiber strand rope, surrounded with a jacket braided from Yarn A. Spectra 900 fiber has a denier of 1200, 118 filaments per strand typically, tensile strength of 2.6 GPa, modulus of 120 GPa and elongation of 3.5 percent.

The three jacketed ropes were tested by a guillotine test. In the guillotine test, the rope was held in a fixture so its movement was restricted. Clamps prevented it from moving along its axis and the rope was inside two pieces of pipe to prevent it from deflecting during cutting. The two pieces of pipe were separated very slightly where the blade made the cut. The maximum force needed to completely sever the rope was measured.

In the second test, the cut-damage test, the rope was laid on a wooden surface without further restraint. A blade was then forced into the rope at 250 pounds (113.6 kg) of force. The damaged ropes were tested for retained strength. In both tests a new Stanley blade no. 1992 was used for each sample tested. The results of the tests are given below.

| Guillotine Test Results Pounds of Force to Cut | | | |
|---|---|---|---|
| Test | Comparative Sample 1 | Comparative Sample 2 | Sample 3 |
| | (kg) | (kg) | (kg) |
| 1 | 132 (60) | 227 (103) | 684 (311) |
| 2 | 139 (61.8) | 335 (152) | 638 (290) |
| 3 | 144 (65.5) | 286 (130) | 616 (280) |
| Avg. | 138 (62.7) | 282 (128) | 646 (294) |
| Cut Damage Test Results, Percent Strength Retained | | | |
| | 73 | 85 | 97 |

Observation of the cut damage test ("abused") ropes showed that the Sample 1 rope was cleanly cut part way through. The Sample 2 rope jacket was also partly cut through but the filaments were not as cleanly cut. Sample 3 rope showed only a depression where the blade was pressed. There was no evidence of even the jacket having been cut. Because of this only Sample 3 rope was tested at 500 pounds force in the cut damage test. It retained 92 percent strength and sustained no jacket cutting.

EXAMPLE 2

Abrasion Resistance

Comparative Sample 2 and Sample 3 (this invention) were tested for abrasion resistance of the jacket by the test described below. Sample 3 was a ¼-inch (0.6 cm) stranded rope jacketed with a braided fabric of yarn A.

In the test each sample rope was bent in a 90 degree angle over a 10-inch (25.3 cm) diameter abrasive wheel. The ropes were loaded with 180 pounds (81.8 kg) and reciprocated through a 3-inch (7.6 cm) stroke as the abrasive wheel rotated at 3 rpm. The test ended when the jacket wore through. The number of strokes (cycles) for each was 8 for Comparative Sample 2 and 80 for Sample 3.

EXAMPLE 3

Braided Rope

Four ¼-inch (0.6 cm) braided ropes were tested with various jackets. Comparative Sample 4 rope was braided from the high strength, ultrahigh molecular weight polyethylene yarn described above and the jacket was braided from a polyester yarn of 1000 denier, 192 filaments per end, 1.05 GPa tensile strength, 15.9 GPa modulus, and 15 percent elongation.

Sample 5 rope was braided from Kevlar yarn of 1875 denier, 2.53 GPa tensile strength,660.4 GPa modulus and 3.5 percent elongation. The jacket was as in Sample 3.

Sample 6 rope was also braided, from the high strength ultrahigh molecular weight polyethylene yarn described above, under low tension to give a "soft" rope. The jacket used was as in Sample 3.

Sample 7 rope was identical to Sample 6 except more tension was applied during braiding of the rope to create a "hard" rope.

A fixed load was applied to the rope as in Example 1. When the ropes were taut under the knife, there was little difference in cut resistance between ropes. In the cut damage test, the results are below.

| Cut Damage Tolerance Percent Strength Retained | | | |
|---|---|---|---|
| Sample | | | |
| 4 | 5 | 6 | 7 |
| 43 | 54 | 100 | 82 |

Best Mode

The following is the best mode of this invention.

It is believed the most cut resistant structure, rope, webbing or strap, would use either of the above described ultrahigh molecular weight polyethylene fibers as core, either braided or as strands, covered by a jacket made, preferably braided, from a yarn having the inner strands of 0.11 mm stainless laid parallel to a strand of the ultrahigh molecular weight polyethylene fiber of highest tensile strength (Spectra 1000), the strands being wrapped with an inner wrap of the lower tensile strength polyethylene fiber (Spectra 900) and outer wrap of polyester fiber described in yarn B, above.

A laboratory study of eleven lines was undertaken by an independent laboratory to ascertain the degree of fishbite resistance which each one might have when used as a deep sea mooring line. In addition to general considerations based upon the composition and construction of the lines, three laboratory tests were used for objective measurement of resistance to stabbing and cutting. Tests were run on the lines when unstressed and when under a working load.

CONSTRUCTION OF LINES

All of the test lines had cores composed of parallel synthetic fibers. Six lines had cores of polyester fiber. Three had cores of Kevlar fiber, and one had a core of Spectra ®900.

The cores of lines with polyester cores were wrapped with a tape of polyester cloth which in turn was covered by a braided polyester cover. The cores of ropes from other sources had a wrapping which appeared to be the same. Table I contains a summary of information on the test lines. Sample 9 is illustrative of the invention herein. All other samples are thought to be comparative.

TEST METHODS

Resistance to penetration by sharp points was measured in two ways: 1) using the Shore D scale of a Durometer (ASTM method #2240), and by stabbing with a simulated shark tooth of hardened steel as described in the "Deep-Sea Lines Fishbite Manual" (Prindle & Walden, 1975). Each data point from the penetration tests is an average of five measurements of the force required to pierce the surface of a line to a standard distance.

Force-to-Cut tests were run on unstressed line samples using the Baldwin Universal Testing Machine as described and illustrated in the "Deep-Sea Lines Fishbite Manual."

In so far as possible within constraints of time and availability of materials, stab and cut tests were repeated on the lines loaded with 1125 lbs. tension. The load was applied by lifting a weight with the test line. The ends of most rope specimens were secured by means of a "Chinese finger" method in which the end of the test line was inserted inside a hollow braid rope which secured it by friction when tension was applied. Durometer and Stab tests were run in the usual ways, but Force-to-Cut tests were done with the cutting blade mounted in a stirrup which was used to pull the blade across the test line. This method is also illustrated in the "Deep-Sea Lines Fishbite Manual" using a shark jaw as the cutting instrument.

All cutting force data are the result of single cuts on the lines indicated. Tests were run on line samples at ambient conditions of approximately 70° F. and variable relative humidity.

LABORATORY TEST RESULTS

Data from three previously tested 13/32" diameter polyester ropes both unprotected and armored have been added as standards of reference. Of the two armors, acetal copolymer (Celcon M25-04) confers a high degree of bite resistance. When tested at sea, it proved adequate to protect a line under strong biting attack. Unfortunately, the Celcon M25-04 formulation cracked during handling so it is not a practical armor, but it is useful here as an example of material with the degree of toughness needed. The second reference line was armored with nylon 6/6 (Zytel ST 801). It is typical of many plastic covered lines in that it has good handling qualities but it is less bite resistant than the acetal copolymer. It is regarded as a marginal fishbite armor marking the bottom of the range of acceptable materials. If a jacket has less stab and cut resistance than nylon 6/6, it probably would not be a trustworthy barrier against fishbite damage in all situations.

Results of the laboratory tests are summarized, and where available, the generic and trade names of fibers and plastic jackets are given in Table II. The thickness of plastic jackets was measured on pieces taken from the test lines and is noted in parentheses after each generic name. A few data are missing, as in the case of sample #1, where the available sample was destroyed in preliminary testing. It was not replaced because sample #6 is a duplicate with a heavier jacket. Problems in finding adequate terminations for lines #10 were not resolved in time for this report, so they were not tested under tension.

EVALUATION OF THE LINES

Due to the variety of line constructions, and the characteristics of test methods, there is no obvious winner in all categories. To aid in interpreting the data, tables have been prepared for each test used.

Table III illustrates data obtained with the Durometer and it is evident that by this test none of the lines submitted was equal to either of the armored reference lines i.e. Acetal Copolymer (AC) or Nylon (N), when tested without tension. The best of the test lines were #1 armored with 47 mils of ionomer, #6 armored with 76 mils of ionomer, and #10 armored with 114 mils of polyester. The rest were below a level which would seem to warrant further consideration. However, some mention should be given to the samples armored with braids. They are #7 armored with polyolefin and aluminum braid, #8 armored with Kevlar braid, and #9 armored with polyurethane and a metal braid. All three ranked low in the Durometer test, probably because the conical point of the Durometer slipped between the strands of the braids. #8, which ranked last in this test, was first in cut resistance. Hence, it appears that the Durometer test may be a useful measure of toughness for homogeneous plastic armors, but is not the whole story when used on items with a discontinuous cover.

In all cases where lines were tested slack and again when stressed, the Durometer readings were either the same within experimental error or increased when the line was under tension.

STAB TEST

The single tooth stab test is similar to the Durometer test in that a pint is forced into the line, but there is the added possibility of cutting by the tooth edges. Table IV illustrates the relative resistance of the lines under this test.

When the lines were tested slack, the Acetal Copolymer (AC) was again the most resistant, requiring 63 lbs. to pierce. Second place went to #10, armored with 114 mils of polyester. It had 70% the resistance of the acetal copolymer reference line and out performed the Nylon 6/6 (N) reference standard. Next in line was item #9, armored with polyurethane and braid. The next few spots went to items #1, 5, 6, and 7 with only 71% the stab resistance of the marginally acceptable nylon 6/6 covered line.

Tension produced marked changes in the ratings. #1 spot went to item #9, urethane and braid armor, which rose from 35 lbs. resistance to 58 lbs. Under tension, it was substantially equal to acetal copolymer in the unstressed condition. With tension, there were 3 lines closely competitive for second place at a level of about 38 lbs. which is the same as the acetal copolymer reference line, and better than the nylon 6/6 armored line at 31 lbs. All three braid-covered lines showed an increase in resistance to stabbing when a tensile load was applied.

FORCE TO CUT

In the cutting force test, unlike the others, progress of the cutting edge can only be made when armor and fibers have been severed. The test results shown in Table V are now quite different.

Four of the test lines were more resistant to cutting than the two reference lines, both in the relaxed and in the stressed conditions.

With two outstanding exceptions, items #8 and 9, all lines lost cut resistance when tested under tension. The five lines which were comparable to the nylon 6/6 reference, when tested slack, dropped to levels so low as to eliminate them from further consideration.

CHOICE OF LINES FOR TEST AT SEA

A choice of lines for test at sea is complicated by variables in line materials and construction. Overall, there are three kinds of constructions represented:

1. Ropes armored with a layer of plastic only.
2. Ropes covered with a braid only.
3. Ropes jacketed with a combination of braid and plastic.

A review of the test data as illustrated in Tables III, IV and V together with available information on the lines will show that there is at least one rope in each category that merits further study.

Taking the lines in order of their overall resistance to puncture and cutting, the best five lines are as follows:

Sample 10—⅝" dia. Kevlar rope armored with 114 mils of polyester (Hytrel). This line is bulky and very stiff. It could only be handled with heavy machinery. Unfortunately, a method for terminating this line could not be managed in time for this report, but results on the unstressed line indicate that it is worth consideration for further tests.

Sample 9—¼" dia. rope of Spectra ® 900 fiber coated with a polyurethane over SPECTRA fiber plus metal core yarn braid jacket. This line is flexible and has good handling qualities. It is vulnerable to stabbing when slack but gains resistance when under a working load. It was superior to the acetal copolymer reference line in resistance to cutting. 15 Information on the susceptibility to deterioration in sea water is needed to complete the information required for an unqualified recommendation of this line for a test at sea.

Sample 7—5/16" dia. Kevlar rope with polyolefin and aluminum braid armor. The armor on this line was composed of 35 mils of polyolefin over the Kevlar fiber plus a layer of aluminum braid plus 41 mils of polyolefin. It was a good handling line albeit a bit stiffer than some others. The Durometer test was below that of nylon 6/6. Stab test on the relaxed rope was below that of nylon 6/6 but when the line was loaded it became much more resistant to stabbing and was about equal to acetal copolymer. In the cut test, it ranked third when unstressed and when stressed, it was superior to both of the reference lines. This is a good line and worth a test at sea.

Sample 6—½" dia. polyester fiber (SynCore) rope with 76 mils of ionomer (Surlyn) jacket. This line had good handling properties, however, overall it was a little below the nylon 6/6 reference line in the three tests. It would be interesting in a test at sea as a line with minimal resistance for the job of fishbite prevention.

Sample 8—⅜" dia. Kevlar with a coarse Kevlar braided jacket. This line was interesting in that it was near the bottom in resistance to penetration, especially when slack, however, it was number one in cut resistance. The effect of tension was to increase its resistance in all three tests. Loaded, it became so resistant to cutting that the steel blade was broken before the line suffered any significant damage. More testing of this type of line with reference to fishbite is definitely indicated.

Overall, the results indicate that braids have interesting properties in resistance to cutting but they are susceptible to penetration by sharp points especially when a line is slack. Plastic armors, on the other hand, lose cut resistance when stretched. Combinations of the two should probably be investigated further toward making a line with effective bite resistance under all conditions.

TABLE I

Lines submitted for laboratory tests
Relative to Fishbite resistance

| Sample No. | Construction: Core | Construction: Jacket (mils) |
|---|---|---|
| | (All lines parallel fiber core) | |
| 1 | 1/2" polyester | Ionomer (47) Surlyn |
| 2 | " | Polyurethane Texin |
| 3 | " | Thermoplastic elastomer (41) Kraton |
| 4 | " | Thermoplastic elastomer (43) Santoprene |
| 5 | " | Polyester (52) Hytrel |
| 6 | " | Ionomer (76) Surlyn |
| 7 | 5/16" Kevlar | Polyolefin and aluminum braid |
| 8 | 3/8" Kevlar | Kevlar braid |
| 9 | 1/4" Spectra | Urethane coated braid* |
| 10 | 5/8 Kevlar | Polyester (114) Hytrel |

*braid made from yarn of strands of SPECTRA ® fiber combined with stainless wire, first wrapped with SPECTRA fiber, then wrapped with polyester fiber.

TABLE II

Resistance of lines to cutting and stabbing

| Sample Number | Construction: Core | Construction: Jacket (mils) | Durom.-Shore D: Un-Stressed | Durom.-Shore D: 1125 lb. Tension |
|---|---|---|---|---|
| 1 | ½" Polyester | Ionomer (47) | 65 | — |
| 2 | " | Polyurethane (56) | 34 | 44 |
| 3 | " | Thermoplastic elastomer (41) | 23 | 28 |
| 4 | " | Thermoplastic santoprene (43) | 19 | 28 |
| 5 | " | Polyester (52) | 49 | 52 |
| 6 | Polyaramide | Ionomer (76) | 65 | 66 |
| 7 | 5/16" Kevlar | Polyolefin and | | |

TABLE II-continued

| Resistance of lines to cutting and stabbing | | | | |
|---|---|---|---|---|
| | | aluminum braid | 50 | 51 |
| 8 | 3/8" Kevlar | Kevlar braid | 14 | 30 |
| 9 | ¼" Spectra | Polyurethane coated braid** | 46 | 51 |
| 10 | 5/8" Kevlar | Polyester (114) | 59 | — |
| AC | 13/32" Polyester | Acetyl copolymer (78) | 81 | — |
| N | " | Nylon 6/6 (63) | 78 | — |
| O | " | None | — | — |

| Sample Number | Stab Force-lbs. Unstressed | Stab Force-lbs. 1125 lb. Tension | Cut Force-lbs. Un-Stressed | Cut Force-lbs. 1125 lb. Tension |
|---|---|---|---|---|
| 1 | 28 | — | 115 | — |
| 2 | 23 | 31 | 97 | 22 |
| 3 | 11 | 22 | 98 | 14 |
| 4 | 12 | 17 | 34 | 6 |
| 5 | 27 | 36 | 107 | 23 |
| 6 | 29 | 38 | 107 | 45 |
| 7 | 27 | 38 | 306 | 264 |
| 8 | 13 | 50 | 377 | >480 |
| 9 | 35 | 58 | 221 | 300 |
| 10 | 44 | — | 352 | — |
| AC | 63 | 38* | 121 | >45* |
| N | 39 | 31* | 104 | >37* |
| O | — | — | 14 | 2* |

*1200 lbs. tension on the line
**See footnote Table I

TABLE III

| Sample No. | Armor Material Thickness Mils | Rank | Durometer Test: Resistance to Reaction Durometer-Shore D Unstressed | Under Tension |
|---|---|---|---|---|
| 1 | 47 | 3 | 63 | — |
| 2 | 56 | 8 | 36 | 43 |
| 3 | 41 | 9 | 23 | 25 |
| 4 | 43 | 10 | 19 | 24 |
| 5 | 52 | 6 | 48 | 52 |
| 6 | 76 | 3 | 63 | 64 |
| 7 | — | 5 | 48 | 50 |
| 8 | — | 11 | 14 | 26 |
| 9 | — | 7 | 44 | 52 |
| 10 | 114 | 4 | 58 | — |
| AC | 78 | 1 | 80 | — |
| N | 63 | 2 | 78 | — |

TABLE IV

| Sample No. | Rank | Stab Test: Force to Stab-lbs. Unstressed | Under Tension |
|---|---|---|---|
| 1 | 6 | 26 | — |
| 2 | 8 | 23 | 31 |
| 3 | 11 | 12 | 21 |
| 4 | 10 | 13 | 17 |
| 5 | 7 | 24 | 38 |
| 6 | 5 | 28 | 38 |
| 7 | 7 | 24 | 38 |
| 8 | 9 | 14 | 16 |
| 9 | 4 | 35 | 58 |
| 10 | 2 | 43 | — |
| AC | 1 | 63 | 38 |
| N | 3 | 39 | 31 |

TABLE V

| Sample No. | Rank | Force to Cut: Force to Cut-lbs. Unstressed | Under Tension |
|---|---|---|---|
| 1 | 6 | 110 | — |
| 2 | 10 | 95 | 20 |
| 3 | 9 | 95 | 15 |
| 4 | 11 | 25 | 5 |
| 5 | 7 | 105 | 20 |
| 6 | 7 | 105 | 30 |
| 7 | 3 | 310 | 270 |
| 8 | 1 | 360 | >480 |
| 9 | 4 | 230 | 300 |
| 10 | 2 | 340 | — |
| Unjacketed | 12 | 10 | 5 |
| AC | 5 | 230 | >30 |
| N | 8 | 105 | >25 |

What is claimed is:

1. A cut resistant article comprising (a) a less cut resistant member surrounded by (b) a more cut resistant jacket, said more cut resistant jacket comprising a fabric of yarn, said yarn in said fabric consisting essentially of (c) at least one high strength longitudinal strand having a tensile strength of at least 1 GPa, and (d) a fiber wrapped around said strand.

2. The article of claim 1 wherein said fiber wrapped around said strand also has a tensile strength of at least 1 GPa.

3. The article of claim 1 wherein the less cut resistant member is selected from the group consisting of rope, webbing, strap, hose and inflatable structure.

4. The article of claim 1 wherein the strand is selected from the group consisting of aramid, ultrahigh molecular weight polyolefin, carbon, metal, fiber glass and combinations thereof.

5. The article of claim 4 wherein the polyolefin is polyethylene.

6. The article of claim 1 wherein the fiber wrapping is selected from the group consisting of aramid fiber, ultrahigh molecular weight polyolefin fiber, carbon fiber, metal fiber, polyamide fiber, polyester fiber, fiber glass, polyacrylic fiber, normal molecular weight polyolefin fiber and combinations thereof.

7. The article of claim 2 wherein the fiber wrapping is selected from the group consisting of aramid fiber, ultrahigh molecular weight polyolefin fiber, carbon fiber, metal fiber and combinations thereof.

8. The article of claim 7 wherein the fiber wrapping also contains a lower strength fiber selected from the group consisting o polyamide, polyester, fiber glass, polyacrylic fiber and combinations; thereof.

9. The article of claim 1 wherein more than one jacket surrounds said less cut resistant member.

10. The article of claim 1 wherein said jacket also comprises a material present in the interstices of the fabric to bond the yarn of fabric to adjacent yarn of the fabric, thereby increasing penetration resistance of the jacket.

11. The article of claim 10 wherein said material is an elastomer.

12. The article of claim 10 wherein said elastomer is a thermoplastic rubber.

13. The article of claim 10 wherein the material used to bond the yarn of the fabric to itself is selected from the group consisting of polyurethane, polyethylene and polyvinyl chloride.

* * * * *